US005927515A

United States Patent [19]

Llaurado Morant

[11] Patent Number: 5,927,515

[45] Date of Patent: Jul. 27, 1999

[54] SUSPENSION SYSTEM ESPECIALLY FOR MOTORCYCLE HELMETS

[76] Inventor: José María Llaurado Morant, Dalmau de Creixell, 10-12, Barcelona, Spain, 08032

[21] Appl. No.: 08/838,946

[22] Filed: Apr. 23, 1997

[30] Foreign Application Priority Data

Apr. 26, 1996 [ES] Spain ..... 9600950

[51] Int. Cl.[6] ..... A47F 7/00

[52] U.S. Cl. ..... 211/32; 248/309.1; 211/87.01

[58] Field of Search ..... 211/32, 30, 87.01; 248/309.1, 304, 300, 301, 312.2, 316.3

[56] References Cited

U.S. PATENT DOCUMENTS

| | | | |
|---|---|---|---|
| 1,203,942 | 11/1916 | Walker | 248/312.1 |
| 2,524,396 | 10/1950 | Papalexis et al. | 211/32 X |
| 2,711,873 | 6/1955 | Larin | 248/312.1 X |
| 3,104,013 | 9/1963 | Risk | 211/37 |
| 4,078,755 | 3/1978 | Erickson | 248/312.1 X |
| 4,245,807 | 1/1981 | York | 248/312.1 X |
| 4,684,096 | 8/1987 | Tanaka | 248/309.1 |
| 5,246,195 | 9/1993 | Huff | 248/309.1 |

*Primary Examiner*—Robert W. Gibson, Jr.
*Attorney, Agent, or Firm*—Jacobson, Price, Holman & Stern, PLLC

[57] ABSTRACT

Suspension system especially for motorcycle helmets. The suspension system includes two points located at different heights, on which the back of the helmet rests, it is supported on the outside at the lower point and on the inside at the top point. These points are defined by the ends of a basically C-shaped component, which is attached to a fixture by a third point. The system provides proper, stable support for the helmets, in any work or habitual place, preventing the normal, unstable support of these, with the possibility they will fall and, consequently, be damaged.

3 Claims, 2 Drawing Sheets

SUSPENSION SYSTEM ESPECIALLY FOR MOTORCYCLE HELMETS

The invention is concerned with a suspension system especially for motorcycle helmets.

As is well known, motorcycle helmets are very troublesome for their users, as they are normally carried in one hand in order not to leave them on the motorcycle and to prevent them from being stolen.

Users normally come up against the problem that there are no ideal places or fittings for them to leave or hang up the helmets safely and, if they are left on a table or similar, they tend to roll and run a great risk of falling on the floor and being damaged.

This invention eliminates these problems and provides a suspension system, applicable very simply to places frequented by motorcycle riders, or simply in workplaces or equivalent of people who habitually use motorcycles and who normally take the helmet with them, whereby the helmet does not cause them the inconvenience of having to take it with them, since, when they reach their work or habitual place, they can hang it up completely safely in terms of the helmet's integrity, without it producing any hindrance to their work or activity.

The suspension system especially for motorcycle helmets with which this invention is concerned comprises two support points, inside and outside at the back of the helmet, located at different heights.

The helmet is supported on the outside at the lower point and on the inside at the top point.

According to the invention, both points are connected to each other by at least one component which is attached to a fixture by a third point.

This component is basically C-shaped, and its ends define the two support points.

According to the invention, the third point can be located between the two support points or in an extension of one of the branches of the component.

These and other features will be made clearer from the detailed description which follows, to assist which two sheets of drawings are attached, showing a practical case of embodiment, which is cited solely as an example, and is not limitative of the scope of this invention.

According to the drawings, the suspension system especially for motorcycle helmets with which this invention is concerned comprises two support points 1 and 2, which are supported inside and outside, respectively, at the back -p- of the motorcycle rider's helmet -C-. These support points 1 and 2 are located at different heights.

Figure 1:
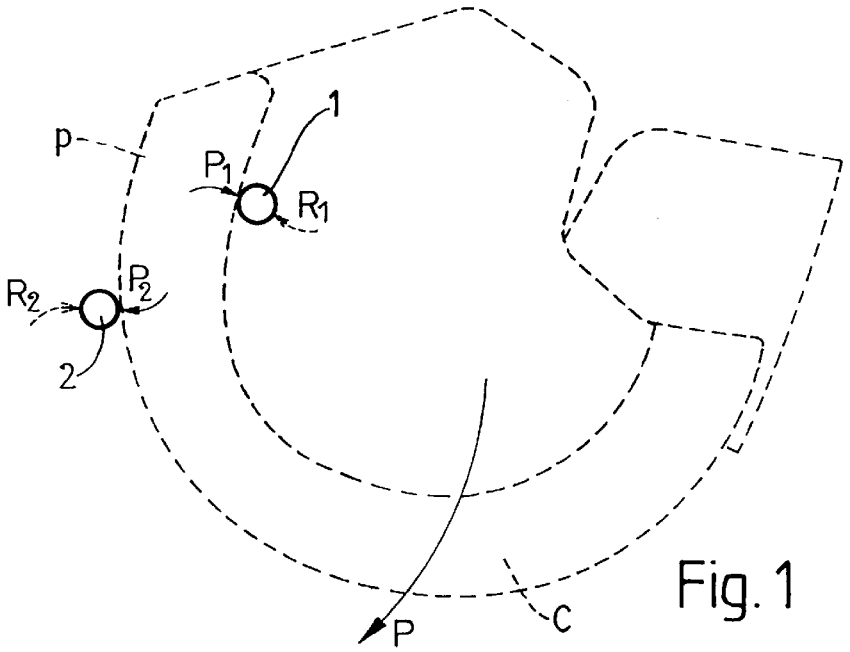
FIG. 1 is an elevational diagrammatic view showing the helmet and the suspension system as per the invention.

FIG. 1 represents a diagrammatic view of the stresses acting on the suspension of the helmet -C-. -P- diagrammatically represents the weight of the helmet -C-, which breaks down into two stresses -$P_1$- and -$P_2$-, which are applied, respectively, at the said points 1 and 2. At both points, by the principle of action and reaction, respective reaction stresses -$R_1$- and -$R_2$- appear, equal to and opposing the aforesaid -$P_1$- and -$P_2$- stresses.

Figure 2:
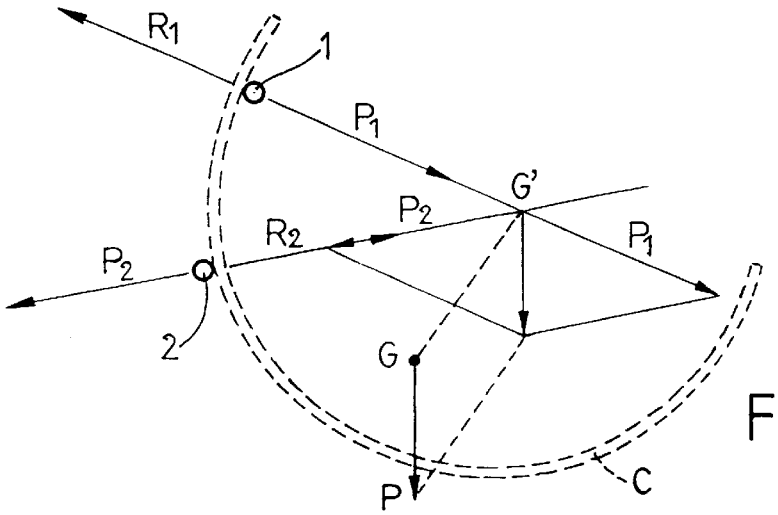
FIG. 2 is a view showing a diagram of stresses of the suspension system.

FIG. 2 shows a static diagram of the said stresses of the suspension system as per the invention. As can be seen, the weight -P- of the helmet -C- applied at the centre of gravity -G- of the helmet breaks down at point -G'- where the stresses meet, in the two parts -$P_1$- and -$P_2$-, which are applied, respectively, at points 1 and 2. At these points, the two aforesaid stresses -$R_1$- and -$R_2$-, equal and opposing, appear by the principle of action and reaction, and these reestablish the balance of the system of stresses, according to the invention.

As can be seen in the figures, the helmet -C- is supported on the outside at the lower point 2, and on the inside it is supported at the top point 1.

According to the invention, the two support points 1 and 2 are connected to each other by a component -E-, which is attached to a fixture -S-, such as a wall or similar, by a third point 3.

As can be seen, this component -E- is basically C-shaped, and its ends define the two support points (see FIGS. 3 to 6).

Figure 3:
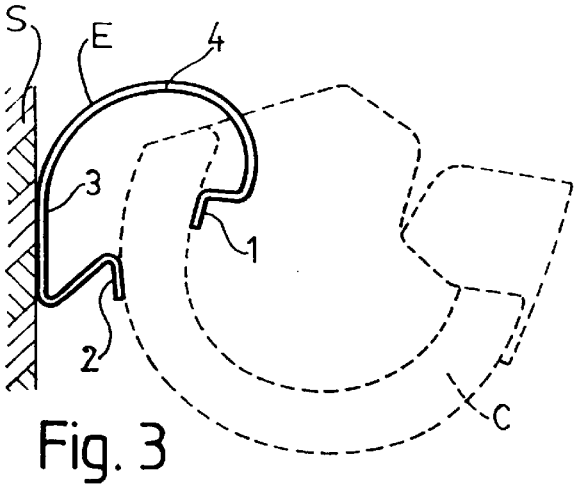
FIGS. 3, 4 and 5 show an elevational view of an embodiment of the system as per the invention.
Figure 4:
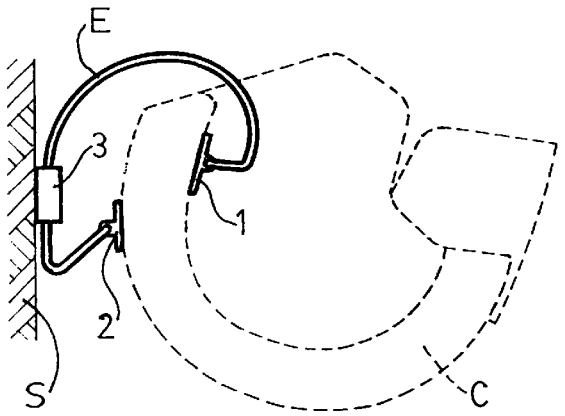
Figure 5:
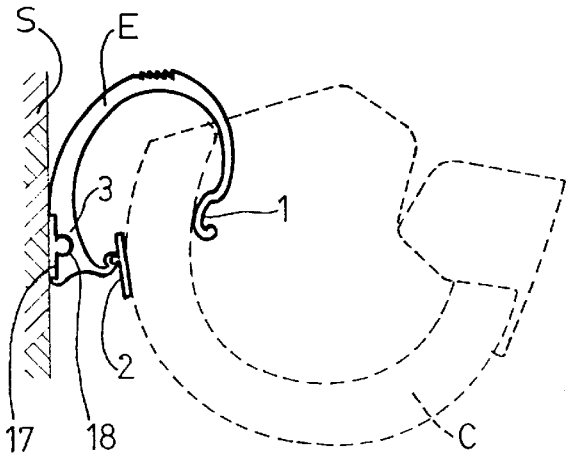
Figure 6:
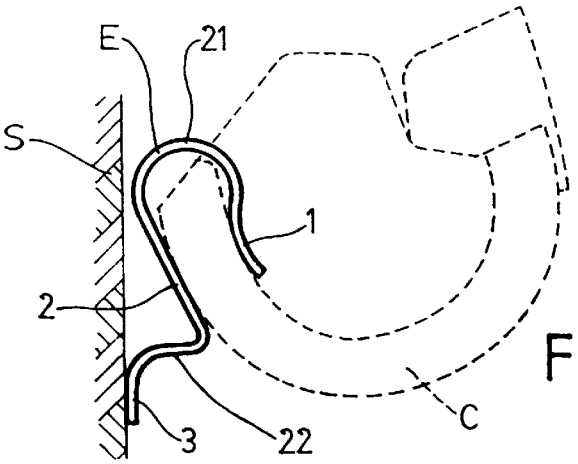
FIG. 6 shows an elevational view of another embodiment of the system as per the invention.

According to the invention, the aforesaid third point 3 for attachment of the component -E- to the fixture -S- is located between the two support points 1 and 2, as is shown in FIGS. 3 to 5. Similarly, this third point 3 can be provided with an extension of one of the branches of the C-shape of the component -E-, as is shown in FIG. 6. Although in this FIG. 6 the extension is of the branch adjacent to the fixture -S-, it could likewise be of the other branch, away from this fixture.

This invention provides that the component -E- should be in one single piece, as is shown in the figures, or of several pieces, whether or not these are joined to each other.

As is shown in the figures, there are different elements of components -E- which are essentially the same, in that they fulfil the purpose of the suspension system of the invention.

Figure 3A:
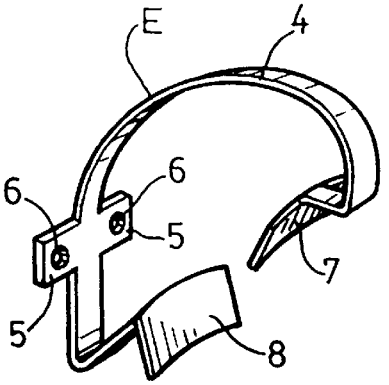
FIGS. 3*a*, 4*a* and 5*a* show a perspective view of specific embodiments.

Thus, component -E- shown in FIG. 3*a* consists of a strip 4 bent in a C-shape, which, in the middle, has two sideways extensions 5, provided with respective holes 6, which forms the said third point 3, for attachment to the fixture -S-. At the ends, it defines two curved plaques 7 and 8, which form the support points 1 and 2 respectively, replacing the points with small surfaces, which improve the support and prolong the life of the helmet -C-.

Figure 4A:
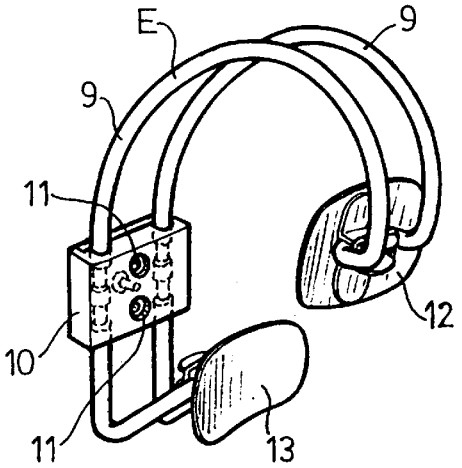

The component -E- shown in FIG. 4*a* consists of two parallel branches 9, connected in the middle by a coupling 10 with a cover, provided with two holes 11, which forms the said third point 3, to attach the component -E- to the fixture -S-. At the joined ends of these branches 9, there are directional rubbers or pads 12, 13, in any suitable material, and these form the support points 1 and 2 respectively, replacing the points with small, directional, surfaces, with the advantages already pointed out.

Figure 5A:
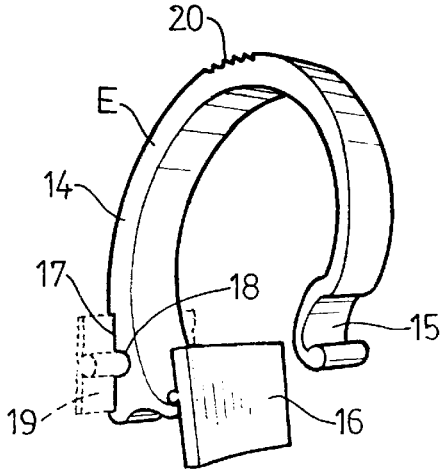

The component -E- shown in FIG. 5*a* consists of a component 14, the top end of which defines a rounded shape 15, which forms support point 1, and the opposite, lower end of which, has a plaque 16 which rocks vertically, which forms support point 2. In the middle, lower down, it has a crosswise recess 17 with an intermediate thickening 18 below, which forms the said third point 3, and enables it to be connected by sliding into a means 19 shaped accordingly, which is attached lengthways to the fixture -S-. This component 14 has serrating 20 at the top, which helps any outer garment hung individually, or with the helmet -C-, to be hung up and held fast on this component 14.

The component -E- shown in FIG. 6 consists of a component 21, which, by one of the branches of the -C-, specifically by the branch corresponding to support point 2, is extended by a tab 22, double-elbowed, and at its end which forms the said third point 3, it is attached to the fixture -S-. The invention provides that the extension can be along the other branch, corresponding to support point 1, which would be bent at the top and would fulfil the same function.

According to this invention, the embodiments of component -E- may be any as suitable, as may the materials of which it is made wholly or in part, as it may be in one single material or several, and may be metal, metal with plastic and rubber, plastic, etc., as appropriate.

I claim:

1. Suspension system for a motorcycle helmet, said suspension system comprising:

a C-shaped piece having ends defining a top suspension point and a lower suspension point facing each other and being located at different heights and attachable to a support at a third point for supporting the helmet in an inverted position by a back part of the helmet when the back part of the helmet extends beyond both the top and lower suspension points and contacts an inside of the back part with the top suspension point and contacts an outside of the back part with the lower suspension point so that a suspended position of the helmet is maintained by said top and lower suspension points.

2. Suspension system, according to claim 1, wherein the third point for attachment of the piece to the support is located between the top and lower suspension points.

3. Suspension system, according to claim 1, wherein the third point for attachment of the piece to the support is provided with an extension of a branch of the C-shaped piece.

* * * * *